US008147044B2

(12) United States Patent
Yokouchi

(10) Patent No.: US 8,147,044 B2
(45) **Date of Patent: *Apr. 3, 2012**

(54) LIQUID SUPPLY DEVICE, LIQUID EJECTING APPARATUS, AND LIQUID SUPPLY METHOD

(75) Inventor: Hideya Yokouchi, Okaya (JP)

(73) Assignee: Seiko Epson Corporation, Tokyo (JP)

( * ) Notice: Subject to any disclaimer, the term of this patent is extended or adjusted under 35 U.S.C. 154(b) by 626 days.

This patent is subject to a terminal disclaimer.

(21) Appl. No.: 12/331,907

(22) Filed: Dec. 10, 2008

(65) Prior Publication Data

US 2009/0147054 A1 Jun. 11, 2009

(30) Foreign Application Priority Data

Dec. 11, 2007 (JP) ..... 2007-319816
Aug. 29, 2008 (JP) ..... 2008-222048

(51) Int. Cl.
*B41J 2/175* (2006.01)

(52) U.S. Cl. ..... 347/85; 347/54

(58) Field of Classification Search ..... 347/85, 347/54, 30, 92, 88
See application file for complete search history.

(56) References Cited

U.S. PATENT DOCUMENTS 4,336,547 A 6/1982 Matsumoto et al.
6,059,405 A 5/2000 Mochizuki et al.
2002/0017552 A1* 2/2002 Ishida ..... 228/207
2006/0082621 A1* 4/2006 Tsukada et al. ..... 347/85
2006/0268078 A1 11/2006 Kumagai
2007/0195140 A1* 8/2007 Ishizawa et al. ..... 347/86
2008/0180491 A1* 7/2008 Sugahara ..... 347/70
2008/0259145 A1* 10/2008 Nomura et al. ..... 347/89
2009/0147053 A1 6/2009 Yorouchi
2010/0020139 A1* 1/2010 Yokouchi ..... 347/85
2010/0277553 A1* 11/2010 Karppinen et al. ..... 347/85

FOREIGN PATENT DOCUMENTS

EP 0 903 235 3/1999
JP 08-067010 3/1996
JP 09-011488 1/1997
JP 11-342634 12/1999
JP 2002-355992 12/2002
JP 2004-090453 3/2004
JP 2005-131939 5/2005
JP 2005-288767 10/2005
JP 2006-212846 8/2006
JP 2006-272661 10/2006

OTHER PUBLICATIONS

U.S. Appl. No. 12/331,880, Mail Date Jan. 19, 2011, Office Action.

* cited by examiner

*Primary Examiner* — Ellen Kim
(74) *Attorney, Agent, or Firm* — Workman Nydegger

(57) ABSTRACT

A liquid supply device includes a liquid supply channel that supplies a liquid from an upstream side as a liquid supply source side to a downstream side, on which the liquid is consumed, a first valve that is provided in the liquid supply channel to open and close the liquid supply channel, and a second valve that is provided on a downstream side from the first valve in the liquid supply channel to open and close the liquid supply channel. The first valve is closed when the second valve is open.

6 Claims, 3 Drawing Sheets

LIQUID SUPPLY DEVICE, LIQUID EJECTING APPARATUS, AND LIQUID SUPPLY METHOD

The entire disclosure of Japanese Patent Application No. 2007-319816, filed Dec. 11, 2007 and Japanese Patent Application No. 2008-222048, filed Aug. 29, 2008, are expressly incorporated herein by reference.

BACKGROUND

1. Technical Field

The present invention relates to a liquid supply device, a liquid ejecting apparatus, and a liquid supply method.

2. Related Art

An ink jet printer (hereinafter, simply referred to as "printer") is a known example of a liquid ejecting apparatus that ejects a liquid onto a target from a liquid ejecting head. In this printer, if an ink solvent evaporates from the nozzle of a recording head serving as a liquid ejecting head, an increase in ink viscosity, ink hardening, or dust sticking may occur. The increase in ink viscosity, ink hardening, or dust sticking may cause clogging in the nozzle. In addition, air bubbles may enter the recording head from the nozzle, and defective printing may be caused.

Accordingly, as described in JP-A-2004-90453, in order to suppress nozzle clogging or air bubble mixing, a known printer performs cleaning, so-called choke cleaning. During choke cleaning, in a state where the valve provided in an ink supply channel (liquid supply channel), through which ink is supplied from an ink cartridge serving as a liquid supply source to the recording head, is closed, suction is applied in the recording head from the nozzle forming surface of the recording head through the nozzle. After negative pressure is generated in the recording head by the suction force, and air bubbles in the recording head are caused to expand, the valve is opened, such that ink quickly flows into the recording head from the ink cartridge. In this way, hardened ink in the recording head or air bubbles are forcibly discharged from the nozzle.

In the printer described in JP-A-2004-90453, only one valve that opens and closes the ink supply channel connecting the ink cartridge and the recording head is provided in the ink supply channel. For this reason, during choke cleaning, if the valve is opened, ink flows into the recording head from the ink cartridge through the ink supply channel in an amount corresponding to the negative pressure applied to the ink supply channel through the nozzle of the recording head. Accordingly, in this printer, during choke cleaning, a large amount of ink is wastefully consumed. In addition, when a plurality of ink supply channels correspondingly extend from liquid supply sources and are connected in parallel to the recording head, the amount of ink consumption in the respective liquid supply sources varies due to a difference in channel resistance between the ink supply channels.

SUMMARY

An advantage of some aspects of the invention is that it provides a liquid supply device, which can apply a pressure to a liquid supply channel so as to cause a liquid to quickly flow from an upstream side as a liquid supply source side toward a downstream side in a state where a valve provided in the liquid supply channel is closed, and in this state, even if the valve is open, can prevent the liquid from being wastefully supplied to the downstream side and consumed. Another advantage of some aspects of the invention is that it provides a liquid ejecting apparatus including the liquid supply device, and a liquid supply method.

According to an aspect of the invention, a liquid supply device includes a liquid supply channel that supplies a liquid from an upstream side as a liquid supply source side to a downstream side, on which the liquid is consumed, a first valve that is provided in the liquid supply channel to open and close the liquid supply channel, and a second valve that is provided on a downstream side from the first valve in the liquid supply channel to open and close the liquid supply channel. The first valve is closed when the second valve is open.

With this configuration, if the downstream-side second valve is open, the upstream-side first valve is closed to close the liquid supply channel. For this reason, in a state where the valve provided on the downstream side in the liquid supply channel is closed, the pressure is applied to the liquid supply channel so as to cause the liquid to quickly flow from the upstream side as the liquid supply source side toward the downstream side. In this state, even if the valve is open, the liquid supply to the downstream side is suppressed by the closed first valve on the upstream side. Therefore, wasteful consumption of the liquid in the liquid supply source can be suppressed.

The liquid supply device according to the aspect of the invention may further include a pump that pumps a part of the liquid supply channel between the first valve and the second valve as a pump chamber. When the pump performs a suction action to increase the volume of the pump chamber and suck the liquid into the pump chamber, the first valve may be opened and the second valve may be closed, and when the pump decreases the volume of the pump chamber to eject the liquid from the pump chamber, the first valve may be closed and the second valve may be opened.

With this configuration, the pump has the pump chamber between the first valve and the second valve in the liquid supply channel, and performs a pump action. The pump action of the pump enables the first valve on the upstream side from the pump chamber and the second valve on the downstream side to be alternately opened and closed. For this reason, although a large pressurization unit for pressurizing the liquid supply source is not provided, the liquid can be supplied from the upstream side as the liquid supply source side toward the downstream side through the liquid supply channel little at a time.

In the liquid supply device according to the aspect of the invention, the pump may include a displacement member that is displaced so as to increase and decrease the volume of the pump chamber, and an urging member that urges the displacement member in a direction to decrease or increase the volume of the pump chamber.

With this configuration, when the pump performs a pump action to supply the liquid, the displacement member is configured to be displaced against the urging force of the urging member only if the pump performs one of a suction action and an ejection action. Otherwise, the displacement member is displaced to an original state by the urging force of the urging member. Therefore, a drive load of the pump can be reduced.

In the liquid supply device according to the aspect of the invention, the second valve may include a valve body that is displaced between a valve close position where the liquid supply channel is closed and a valve open position where the liquid supply channel is open, and an urging member that urges the valve body toward the valve close position. When the pressure of the liquid ejected from the pump chamber in accordance with an ejection action of the pump is applied as positive pressure, the valve body may be displaced to the valve open position against an urging force of the urging member.

With this configuration, the valve body of the second valve is constantly in a valve close state by the urging force of the urging member, but when the pump performs the ejection action and the pressure of the liquid ejected from the pump chamber is applied to the valve body as positive pressure, the valve body is switched to a valve open state. That is, with the above-described configuration, the open/close state of the second valve can be automatically switched, without providing a special control mechanism.

In the liquid supply device according to the aspect of the invention, the first valve may include a valve body that is displaced between a valve close position where the liquid supply channel is closed and a valve open position where the liquid supply channel is open, and an urging member that urges the valve body toward the valve close position. When the pressure of the liquid sucked into the pump chamber in accordance with a suction action of the pump is applied as positive pressure, the valve body may be displaced to the valve open position against an urging force of the urging member.

With this configuration, the valve body of the first valve is constantly in a valve close state by the urging force of the urging member, but when the pump performs the suction action and the pressure of the liquid sucked into the pump chamber is applied to the valve body as negative pressure, the valve body is switched to a valve open state. That is, with the above-described configuration, the open/close state of the first valve can be automatically switched, without providing a special control mechanism.

According to another aspect of the invention, a liquid ejecting apparatus includes a liquid ejecting head that ejects a liquid, and the above-described liquid supply device.

With this configuration, when the liquid ejecting apparatus performs so-called choke cleaning in which, while the negative pressure is applied to the liquid supply channel through the liquid ejecting head, and the valve provided in the liquid supply channel is switched from the valve close state to the valve open state, thereby forcibly discharging the liquid from the liquid ejecting head, wasteful consumption of the liquid can be suppressed.

According to yet another aspect of the invention, a liquid supply method for a liquid supply device includes, in a state where, when a first valve and a second valve are provided in a liquid supply channel, through which a liquid is supplied from an upstream side as a liquid supply source side toward a downstream side, to open and close the liquid supply channel, and the second valve on a downstream side from the first valve is closed, applying pressure to the liquid supply channel so as to cause the liquid to quickly flow from the upstream side toward the downstream side, and when the second valve is opened to supply the liquid on an upstream side from the second valve to a downstream side, closing the first valve. With this configuration, the same effects as the above-described liquid supply device can be obtained.

In the liquid supply method for the liquid supply device according to yet another aspect of the invention, after a pump provided between the first valve and the second valve pumps a part of the liquid supply channel as a pump chamber and the second valve is closed, pressure may be applied to the liquid supply channel so as to cause ink to quickly flow from the upstream side toward the downstream side.

After the pump provided between the first valve and the second valve in the liquid supply channel performs the pump action, the second valve of the downstream side is opened by the ejection pressure from the pump chamber. In this valve open state, if the pressure (negative pressure) is applied to the liquid supply channel so as to cause the liquid to quickly flow from the upstream side toward the downstream side, the liquid in the pump chamber is sucked into the liquid supply channel on the downstream side by the negative pressure until the second valve is closed. As a result, ink is wastefully consumed until the second valve is closed.

With the above-described configuration, first, if the pump performs the suction action, the pressure in the pump chamber decreases, and the second valve on the downstream side from the pump is closed. In the valve close state, the negative pressure is applied to the liquid supply channel from the downstream side. That is, if the negative pressure in the liquid supply channel increases, the second valve is reliably closed, and the liquid in the pump chamber can be prevented from flowing out into the liquid supply channel on the downstream side. In addition, after the second valve is closed, if the pump performs the ejection action, the second valve is opened by the ejection pressure from the pump chamber, and ink flows into the liquid supply channel. As a result, choke cleaning can be performed with a small amount of ink consumption.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, an embodiment in which the invention is applied to an ink jet recording apparatus (hereinafter, referred to as "printer"), which is a kind of liquid ejecting apparatus, will be described with reference to FIGS. 1 to 3.

Figure 1:
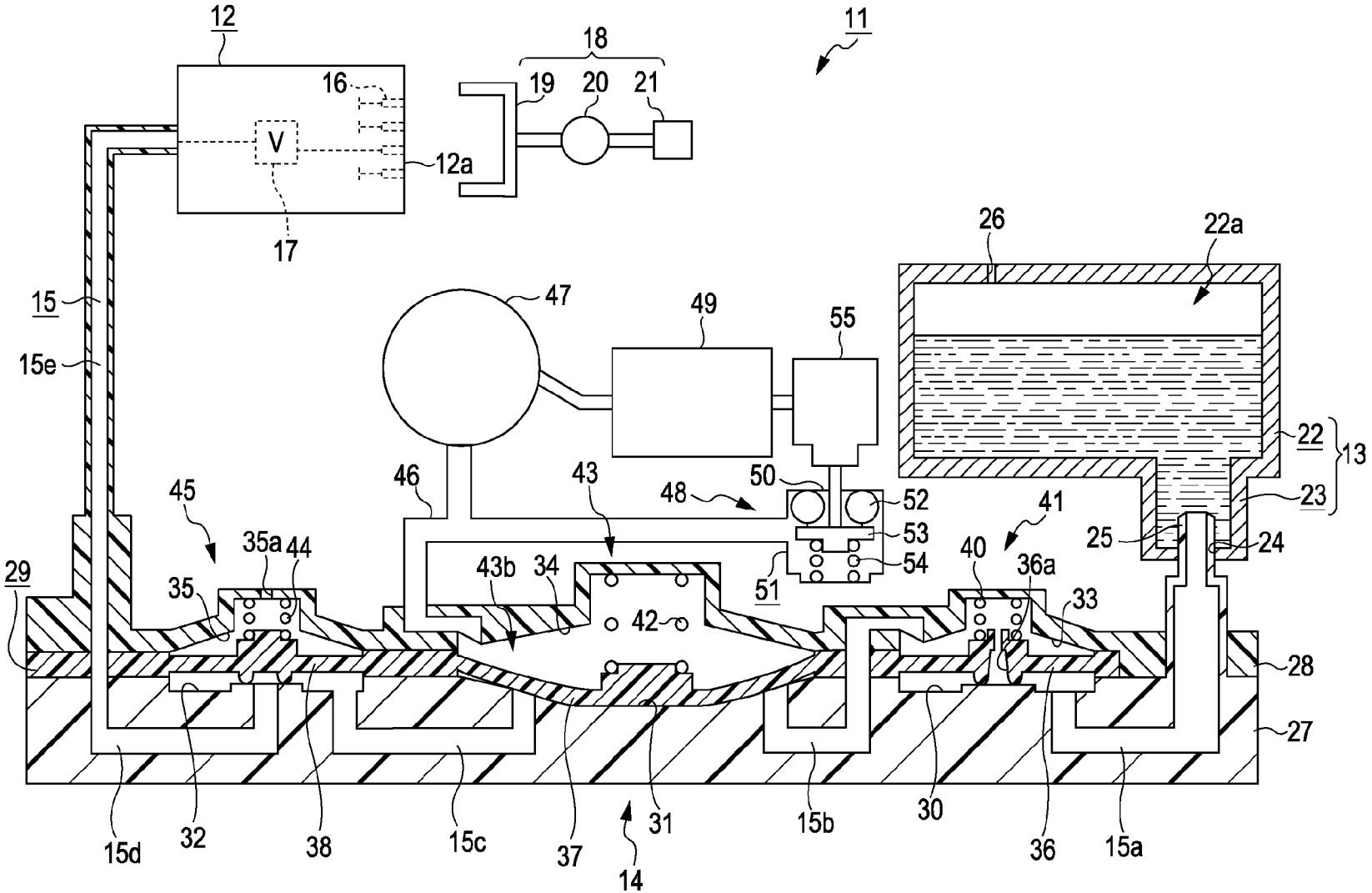
FIG. 1 is a schematic view of an ink jet printer according to an embodiment of the invention.

As shown in FIG. 1, a printer 11 of this embodiment includes a recording head 12 serving as a liquid ejecting head that ejects ink (liquid) onto a target (not shown), and an ink supply device 14 serving as a liquid supply device that supplies, to the recording head 12, ink contained in an ink cartridge 13 serving as a liquid supply source. An ink flow channel (liquid supply channel) 15 is provided through which ink is supplied from an upstream side toward a downstream side, that is, from the ink cartridge 13 toward the recording head 12, in a state where an upstream end of the ink supply device 14 is connected to the ink cartridge 13, and a downstream end of the ink supply device 14 is connected to the recording head 12.

The printer 11 includes a plurality of ink supply devices 14 corresponding to the number of colors (types) of ink used in the printer 11. However, the ink supply devices 14 have the same configuration, and thus FIG. 1 shows one ink supply device 14, which supplies ink of one color, together with the recording head 12 and one ink cartridge 13. In the following description, a case in which ink is supplied from the ink cartridge 13 on the upstream side toward the recording head 12 on the downstream side through the ink flow channel 15 of the one ink supply device 14 shown in FIG. 1 will be described.

As shown in FIG. 1, in the recording head 12, a plurality of nozzles 16 (in this embodiment, four nozzles) corresponding to the number of ink supply devices 14 are formed in a nozzle forming surface 12*a*, which is opposite a platen (not shown). Ink is supplied to each nozzle 16 from the ink flow channel 15 of the corresponding ink supply device 14 through a valve unit 17. The valve unit 17 is provided with a pressure chamber (not shown) that temporarily stores ink from the ink flow channel 15 and communicates with the nozzle 16. When ink is ejected from the nozzle 16, ink appropriately flows into the pressure chamber from the ink flow channel 15 in an amount corresponding to the amount of ink consumed by ink ejection on the basis of an open/close operation of a flow channel valve (not shown).

The printer 11 includes a maintenance unit 18 disposed at a home position of the recording head 12 when printing is not being performed. The maintenance unit 18 cleans the recording head 12 in order to eliminate clogging of the nozzle 16 of the recording head 12. The maintenance unit 18 includes a cap 19 that comes into contact with the nozzle forming surface 12*a* of the recording head 12 so as to surround the nozzle 16, a suction pump 20 that is driven in order to suck ink from the cap 19, and a waste liquid tank 21, to which ink sucked from the cap 19 is discharged as waste ink when the suction pump 20 is driven. During cleaning, in a state where the cap 19 is moved from the state shown in FIG. 1 and comes into contact with the nozzle forming surface 12*a* of the recording head 12, the suction pump 20 is driven. Then, negative pressure is generated in the inner space of the cap 19, and thickened ink or ink mixed with air bubbles is sucked and discharged from the recording head 12 toward the waste liquid tank 21.

Meanwhile, the ink cartridge 13 substantially has a boxlike case 22 in which an ink chamber 22*a* for containing ink is formed. A cylinder 23 communicating with the ink chamber 22*a* is formed to protrude downward from a bottom wall of the case 22, and an ink supply port 24 for discharging ink is formed at a front end of the cylinder 23. When the ink cartridge 13 is connected to the ink supply device 14, an ink supply needle 25, which protrudes from the ink supply device 14 to form an upstream end of the ink flow channel 15, is inserted into the ink supply port 24. An atmosphere communicating hole 26 is formed to pass through an upper wall of the case 22 to enable communication between the ink chamber 22*a* containing ink and the atmosphere, such that atmospheric pressure is applied to the surface of ink contained in the ink chamber 22*a*.

Next, the configuration of the ink supply device 14 will be described in detail.

As shown in FIG. 1, the ink supply device 14 includes a first flow channel forming member 27 that is made of resin and serves as a base, a second flow channel forming member 28 that is made of resin and is laminated on the first flow channel forming member 27, and a flexible member 29 that is made of a rubber plate and is sandwiched between the flow channel forming members 27 and 28 during assembly. Concave portions 30, 31, and 32 having a circular shape in plan view are formed at a plurality of positions (in this embodiment, three positions) on an upper surface of the first flow channel forming member 27. Referring to FIG. 1, one concave portion 31 and two concave portions 30 and 32, which substantially have the same volume so as to be smaller than that of the concave portion 31, are arranged in a horizontal direction so that the concave portion 30, the concave portion 31, and the concave portion 32 are disposed from right to left.

Concave portions 33, 34, and 35 having a circular shape in plan view are formed at a plurality of positions (in this embodiment, three positions) on a lower surface of the second flow channel forming member 28 laminated on the first flow channel forming member 27 so as to be opposite the concave portions 30, 31, and 32 of the upper surface of the first flow channel forming member 27. Referring to FIG. 1, one concave portion 34 and two concave portions 33 and 35, which substantially have the same volume so as to be smaller than that of the concave portion 34, are arranged in a horizontal direction so that the concave portion 33, the concave portion 34, and the concave portion 35 are disposed from right to left.

That is, in the ink supply device 14, the concave portions 30 to 32 or the concave portions 33 to 35 are formed on the same plane, and thus a laminate in which a plurality of plate-shaped members are laminated can be used.

An atmosphere communicating hole 35*a* communicating with the atmosphere is formed in the bottom of the leftmost concave portion 35 in the second flow channel forming member 28 of FIG. 1.

The flexible member 29 is sandwiched between the first flow channel forming member 27 and the second flow channel forming member 28, such that the flexible member 29 is interposed to vertically divide the spaces between the concave portions 30 to 32 of the first flow channel forming member 27 and the concave portions 33 to 35 of the second flow channel forming member 28 at a plurality of positions (in this embodiment, three positions). As a result, a portion of the flexible member 29 interposed between the concave portion 30 of the first flow channel forming member 27 and the concave portion 33 of the second flow channel forming member 28 functions as a suction-side valve body (valve main body) 36 that is elastically deformed between the concave portions 30 and 33 to be displaced.

Similarly, a portion of the flexible member 29 interposed between the concave portion 31 of the first flow channel forming member 27 and the concave portion 34 of the second flow channel forming member 28 functions as a diaphragm (displacement member) 37 that is elastically deformed between the concave portions 31 and 34 to be displaced. In addition, a portion of the flexible member 29 interposed between the concave portion 32 of the first flow channel forming member 27 and the concave portion 35 of the second flow channel forming member 28 functions as an ejection-side valve body (valve main body) 38 that is elastically deformed between the concave portions 32 and 35 to be displaced.

In regard to the area of a deformable portion in plan view of each of the suction-side valve body 36, the diaphragm 37, and the ejection-side valve body 38, the suction-side valve body 36 and the ejection-side valve body 38 substantially have the same size, and the diaphragm 37 is larger than the suction-side valve body 36 and the ejection-side valve body 38.

As shown in FIG. 1, a first flow channel 15*a* is formed in the first flow channel forming member 27 and the second flow channel forming member 28 to enable communication between the ink supply needle 25 protruding from the upper surface of the second flow channel forming member 28 and the concave portion 30 of the first flow channel forming member 27. The first flow channel 15*a* forms a part of the ink flow channel 15 in the ink supply device 14. Similarly, a second flow channel 15*b* is formed in the first flow channel forming member 27, the second flow channel forming member 28, and the flexible member 29 to enable communication between the concave portion 33 of the second flow channel forming member 28 and the concave portion 31 of the first flow channel forming member 27. The second flow channel 15*b* forms a part of the ink flow channel 15 in the ink supply device 14. In addition, a third flow channel 15*c* is formed in the first flow channel forming member 27 to enable communication between the concave portion 31 and the concave portion 32 of the first flow channel forming member 27. The third flow channel 15*c* forms a part of the ink flow channel 15 in the ink supply device 14.

A fourth flow channel 15*d* is formed in the first flow channel forming member 27, the second flow channel forming member 28, and the flexible member 29 to enable communication between the concave portion 32 of the first flow channel forming member 27 and the upper surface of the second flow channel forming member 28. The fourth flow channel 15*d* forms a part of the ink flow channel 15 in the ink supply device 14. A flow channel opening end formed in the upper surface of the second flow channel forming member 28 in the fourth flow channel 15*d* is connected to one end (upstream end) of an ink supply tube 15*e*, which forms a part of the ink flow channel 15 in the ink supply device 14. The other end (downstream end) of the ink supply tube 15*e* is connected to the valve unit 17 in the recording head 12.

As shown in FIG. 1, a portion of the flexible member 29 forming the suction-side valve body 36 in the ink supply device 14 has a through hole 36*a* in a central portion thereof, and is urged toward an inner bottom surface of the lower concave portion 30 by an urging force of a coil spring (urging member) 40 provided in the upper concave portion 33. In this embodiment, the concave portions 30 and 33, the suction-side valve body 36, and the coil spring 40 form a suction-side valve 41 serving as a first valve, which is provided in the ink flow channel 15 to open and close the ink flow channel 15.

Similarly, a portion of the flexible member 29 forming the diaphragm 37 in the ink supply device 14 is urged toward an inner bottom surface of the lower concave portion 31 by an urging force of a coil spring (urging member) 42 provided in the upper concave portion 34. In this embodiment, the concave portions 31 and 34, the diaphragm 37, and the coil spring 42 form a pulsing pump 43. A variable volume space, which is defined by the diaphragm 37 and the lower concave portion 31, functions as a pump chamber 43*a* in the pump 43.

Similarly, a portion of the flexible member 29 forming the ejection-side valve body 38 in the ink supply device 14 is urged toward an inner bottom surface of the lower concave portion 32 by an urging force of a coil spring (urging member) 44 provided in the upper concave portion 35. In this embodiment, the concave portions 32 and 35, the ejection-side valve body 38, and the coil spring 44 form an ejection-side valve 45 serving as a second valve, which is provided on a downstream side from the suction-side valve (first valve) 41 in the ink flow channel 15 to open and close the ink flow channel 15.

In this embodiment, a volume variable space defined by the ejection-side valve body 38 and the lower concave portion 32 has a volume smaller than that of the pump chamber 43*a*, and substantially has the same size as a space defined by the concave portion 32 and the suction-side valve body 36. The urging force of the coil spring 44 is applied in a direction to decrease the volume of a space defined by the ejection-side valve body 38 and the lower concave portion 32.

As shown in FIG. 1, a negative pressure generation device 47 including a suction pump, and an atmosphere opening mechanism 48 are connected to the concave portion 34 of the second flow channel forming member 28 through a two-branch air flow channel 46. When a driving motor 49, which can rotate forward and reversely, is forward driven, the negative pressure generation device 47 is driven by a driving force to be transferred through a one-way clutch (not shown) and generates negative pressure. Similarly, the negative pressure generation device 47 generates negative pressure in the concave portion 34 of the second flow channel forming member 28 connected thereto through the air flow channel 46. From this viewpoint, a volume variable space, which is defined by the concave portion 34 of the second flow channel forming member 28 and the diaphragm 37, functions as a negative pressure chamber 43*b*, which is put in a negative pressure state when the negative pressure generation device 47 is driven.

The atmosphere opening mechanism 48 includes an atmosphere opening valve 53 that is accommodated in a box 51 having an atmosphere opening hole 50 formed therein with a seal member 52 attached to the atmosphere opening hole 50. The atmosphere opening valve 53 is urged by an urging force of a coil spring 54 in a valve closing direction to seal the atmosphere opening hole 50. When the driving motor 49 is reversely driven, the atmosphere opening mechanism 48 is configured such that a cam mechanism 55 is actuated by the driving force to be transferred through the one-way clutch (not shown), and the atmosphere opening valve 53 is displaced in a valve opening direction against the urging force of the coil spring 54 when the cam mechanism 55 is actuated. That is, when the negative pressure chamber 43*b* connected to the atmosphere opening mechanism 48 through the air flow channel 46 is in the negative pressure state, the atmosphere opening valve 53 is opened, and thus the atmosphere opening mechanism 48 opens the negative pressure chamber 43*b* to the atmosphere to release the negative pressure state.

FIG. 1 shows a case in which the negative pressure generation device 47, the atmosphere opening mechanism 48, and the driving motor 49 driving them are individually provided in a plurality of ink supply devices 14 corresponding to ink of respective colors. Alternatively, the following configuration may be used. An end of the air flow channel 46, which is connected to the negative pressure chamber 43*b* of the pump 43 in the ink supply device 14, may branch off so as to correspond to the number of ink supply devices 14 corresponding to ink of the respective colors, and each end of the air flow channel 46 may be connected to the negative pressure chamber 43*b* of the pump 43 in a corresponding one of the ink supply devices 14. With this configuration, a single negative pressure generation device 47, a single atmosphere opening mechanism 48, and a single driving motor 49 may be provided for a plurality of ink supply devices 14, thereby driving the ink supply devices 14 of the respective colors. Therefore, the printer 11 can be reduced in size.

The operation of the printer 11 having the above-described configuration will be described, focusing on the operation of the ink supply device 14.

It is assumed that the state shown in FIG. 1 is immediately after an ink cartridge is replaced with a new one, and the suction-side valve body 36 of the suction-side valve 41, the diaphragm 37 of the pump 43, and the ejection-side valve body 38 of the ejection-side valve 45 are all pressed against the inner bottom surfaces of the concave portions 30, 31, and 32 by the urging force of the coil springs 40, 42, and 44. It is also assumed that the atmosphere opening mechanism 48 is in a valve close state where the atmosphere opening valve 53 seals the atmosphere opening hole 50.

In the state of FIG. 1, when the ink supply device 14 supplies ink from the ink cartridge 13 to the recording head 12, first, the driving motor 49 is forward driven so as to cause the pump 43 to perform a pump action. When this happens, the negative pressure generation device 47 generates negative pressure, and the negative pressure chamber 43*b* of the ink supply device 14 connected to the negative pressure generation device 47 through the air flow channel 46 is put in the negative pressure state. For this reason, the diaphragm 37 of the pump 43 is elastically deformed (displaced) toward the negative pressure chamber 43*b* against the urging force of the coil spring 42, and decreases the volume of the negative pressure chamber 43*b* (see FIG. 2). As the volume of the negative pressure chamber 43*b* decreases, the pump chamber 43*a* of the pump 43, which is separated from the negative pressure chamber 43*b* by the diaphragm 37, reversely increases in volume.

That is, the pump 43 displaces the diaphragm 37 in a direction to increase the volume of the pump chamber 43*a* and performs the suction action. Specifically, the diaphragm 37 is displaced from a bottom dead point shown in FIG. 1 to a top dead point shown in FIG. 2. For this reason, the pump chamber 43*a* is put in a negative pressure state, and the negative pressure is applied to the upper concave portion 33 of the suction-side valve 41 through the second flow channel 15*b*. The negative pressure causes the suction-side valve body 36 to be elastically deformed (displaced) upward (that is, in a valve opening direction) in accordance with a pressure difference from the pressure of ink in the lower concave portion 30 against the urging force of the coil spring 40. As a result, the first flow channel 15*a* and the second flow channel 15*b* communicate with each other through the through hole 36*a* of the suction-side valve body 36, and thus ink is sucked into the pump chamber 43*a* from the ink cartridge 13 through the first flow channel 15*a*, the concave portion 30, the through hole 36*a*, the concave portion 33, and the second flow channel 15*b*.

When the pump 43 performs the suction action, the negative pressure of the pump chamber 43*a* is also applied to a downstream side of the ink flow channel 15 from the pump chamber 43*a*, that is, the third flow channel 15*c*, through the third flow channel 15*c*. However, in the concave portion 32 of the ejection-side valve 45 communicating with the downstream side of the third flow channel 15*c*, the ejection-side valve body 38 is urged in the valve closing direction by the coil spring 44, and the valve close state is not changed to a valve open state unless a positive ink ejection pressure (for example, a pressure of 13 kpa or more) is applied to the ejection-side valve body 38 from an upstream side of the third flow channel 15*c* by the ejection action of the pump 43. In this case, the negative pressure is applied to the ejection-side valve body 38 of the ejection-side valve 45, and thus the valve close state is maintained.

Figure 2:
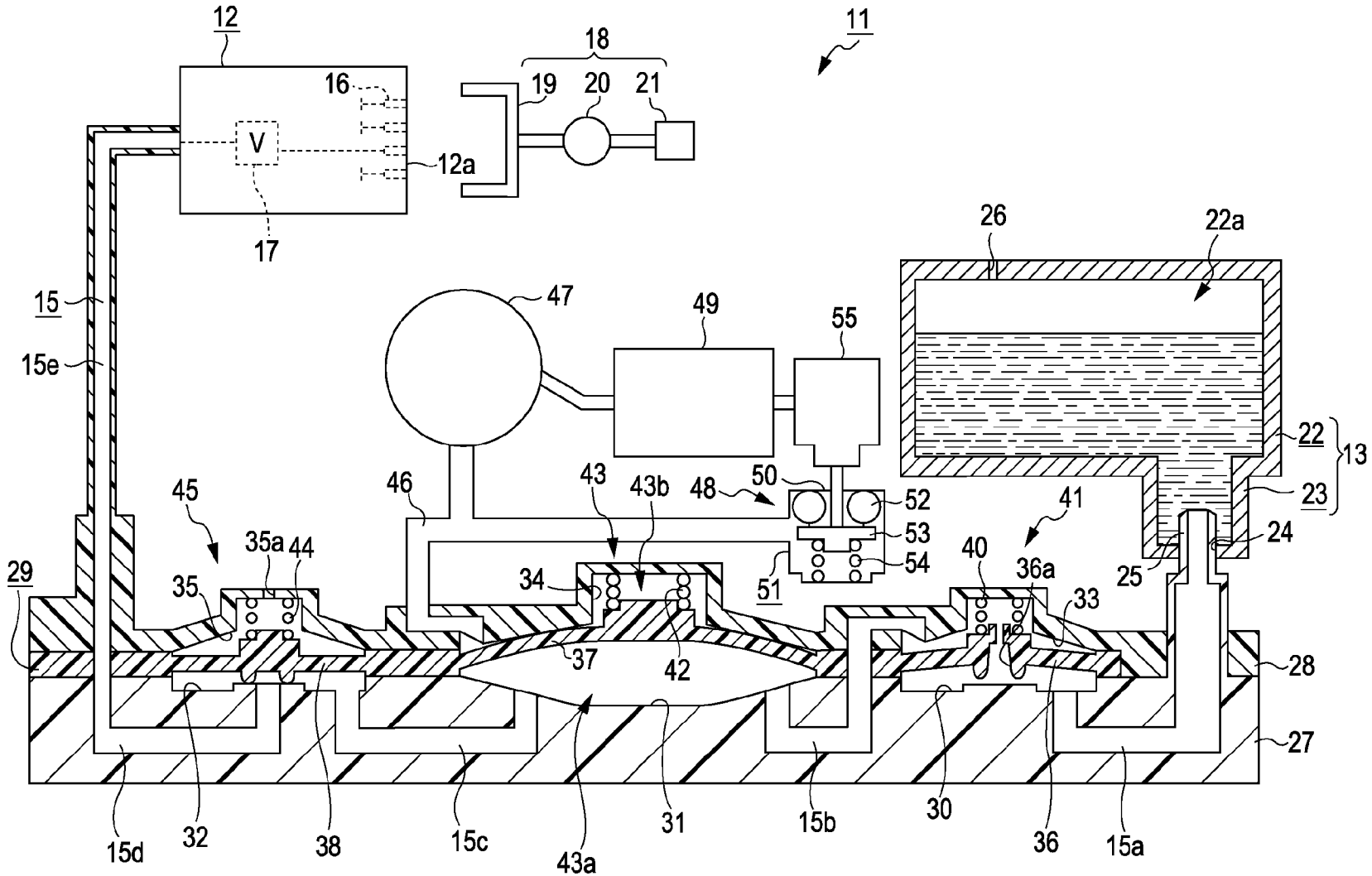
FIG. 2 is a schematic view of an ink jet printer when depressurization.
Figure 3:
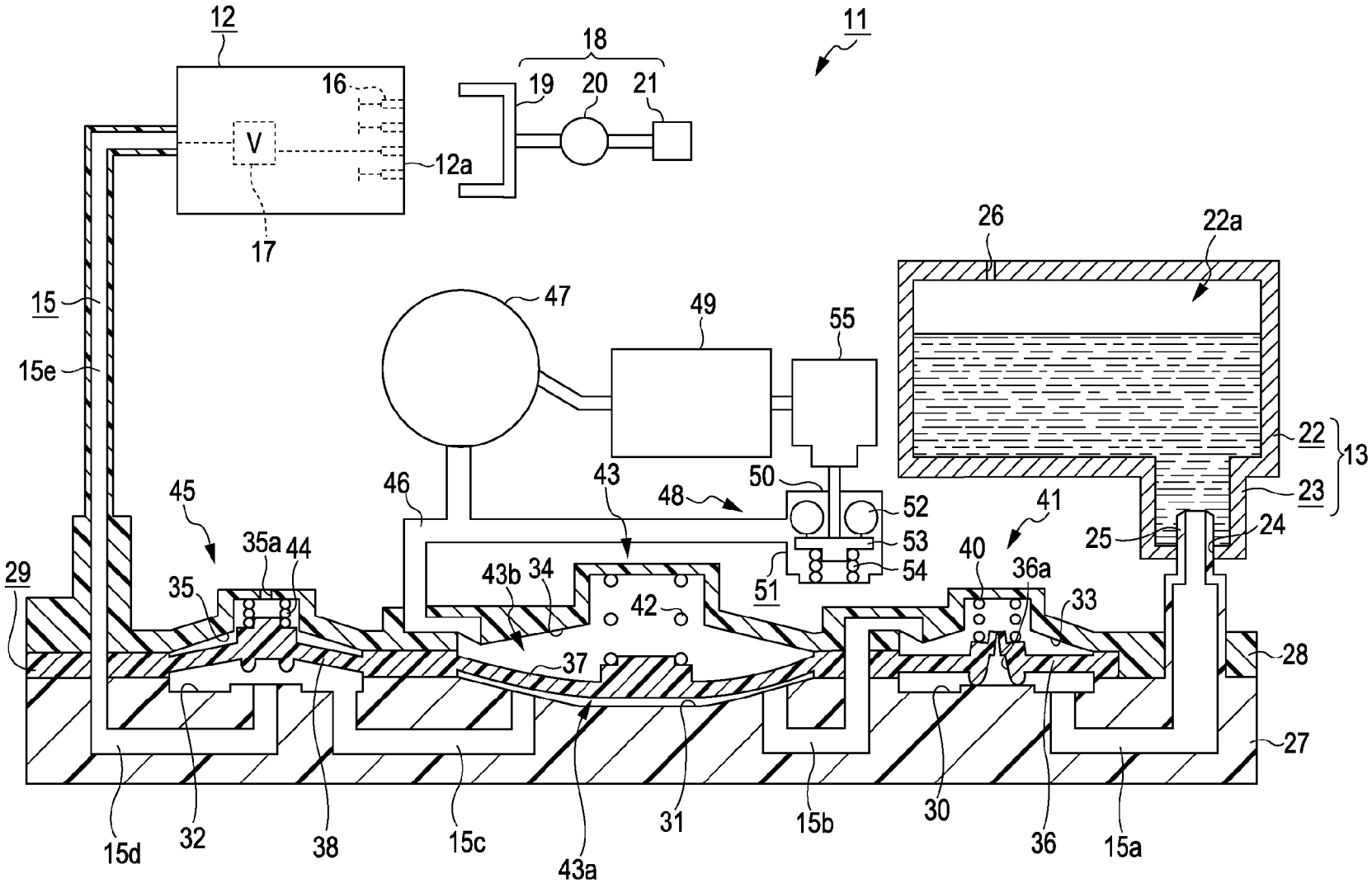
FIG. 3 is a schematic view of an ink jet printer when pressurization.

Next, in the state of FIG. 2, the driving motor 49 is reversely driven. When this happens, the cam mechanism 55 of the atmosphere opening mechanism 48 is actuated, and the atmosphere opening valve 53 is opened against the urging force of the coil spring 54. Then, the negative pressure chamber 43*b* in the negative pressure state is opened to the atmosphere. For this reason, the diaphragm 37 of the pump 43 is elastically deformed (displaced) downward (that is, toward an inner bottom surface of the pump chamber 43*a*) by the urging force of the coil spring 42, and increases the volume of the negative pressure chamber 43*b* (see FIG. 3). As the volume of the negative pressure chamber 43*b* increases, the pump chamber 43*a* of the pump 43, which is separated from the negative pressure chamber 43*b* by the diaphragm 37, reversely decreases in volume.

That is, the pump 43 displaces the diaphragm 37 in a direction to decrease the volume of the pump chamber 43*a* and performs the ejection action. Specifically, as shown in FIG. 3, the diaphragm 37 is displaced from the top dead point toward the bottom dead point, and pressurizes ink sucked into the pump chamber 43*a* with a predetermined pressure (for example, a pressure of approximately 30 kpa). For this reason, ink is ejected from the pump chamber 43*a*, and the ejection pressure is applied to the upper concave portion 33 of the suction-side valve 41 through the second flow channel 15*b* on an upstream side from the pump chamber 43*a*. The ejection pressure causes the suction-side valve body 36 to be elastically deformed (displaced) downward (that is, in a valve closing direction) in cooperation with the urging force of the coil spring 40. As a result, the first flow channel 15*a* and the second flow channel 15*b* no longer communicate with each other as a result of the valve close operation of the suction-side valve body 36. Therefore, suction of ink through the suction-side valve 41 from the ink cartridge 13 into the pump chamber 43*a* is stopped, and ink ejected from the pump chamber 43*a* in accordance with the ejection action of the pump 43 is prevented from flowing back into the ink cartridge 13 through the suction-side valve 41.

When the pump 43 performs the ejection action, the pressure (for example, a pressure of approximately 30 kpa) of ink ejected from the pump chamber 43*a* is also applied to the downstream side of the ink flow channel 15 through the third flow channel 15*c*. For this reason, the ejection pressure of the pump 43 opens the closed ejection-side valve body 38, and the third flow channel 15*c* and the fourth flow channel 15*d* communicate with each other through the lower concave portion 32 in the ejection-side valve 45. As a result, pressurized ink is supplied from the pump chamber 43*a* to the valve unit 17 through the third flow channel 15*c*, the lower concave portion 32 of the ejection-side valve 45, the fourth flow channel 15*d*, and the ink supply tube 15*e*. For reference, when ink flows into the lower concave portion 32 of the ejection-side valve 45 in accordance with the ejection action of the pump 43, the urging force of the coil spring 44 in the ejection-side valve 45 is set to approximately 13 kpa such that the ejection-side valve body 38 can be elastically deformed upward by the ink pressure.

Subsequently, the ejection pressure of ink, which is pressurized by the diaphragm 37 and ejected from the pump chamber 43*a*, is maintained to be balanced over the flow channels (including the pump chamber 43*a* and the lower concave portion 32 of the ejection-side valve 45) on a downstream side from the upper concave portion 33 of the suction-side valve 41 in the ink flow channel 15. That is, in the ejection-side valve 45, the ejection-side valve body 38 is maintained at the top dead point, and is open such that the third flow channel 15*c* and the fourth flow channel 15*d* communicate with each other.

Subsequently, if ink is ejected from the recording head 12 toward a target (not shown), ink is supplied from the ink flow channel 15 to the recording head 12 through the valve unit 17 by an amount corresponding to the amount of ink consumption in ink ejection. For this reason, pressurized ink is supplied from the pump chamber 43*a* to the downstream side, on which the recording head 12 is disposed, in an amount corresponding to the amount of ink consumed on the downstream side (the recording head 12) on the basis of a pressing force of the diaphragm 37, which is urged in the direction to decrease the volume of the pump chamber 43*a* by the urging force of the coil spring 42.

As a result, the volume of the pump chamber 43*a* and the volume of a space defined by the lower concave portion 32 in the ejection-side valve 45 and the ejection-side valve body 38 gradually decrease. Finally, the diaphragm 37 is displaced to near the bottom dead point, and the ejection-side valve body 38 is displaced to near the valve close position where the fourth flow channel 15*d* is closed. For reference, in this embodiment, the ejection pressure of ink to be pressurized by the diaphragm 37 and ejected from the pump chamber 43*a* becomes approximately 13 kpa.

When this happens, the driving motor 49 is forward driven again, and in the atmosphere opening mechanism 48, the atmosphere opening valve 53 is displaced to a valve close position to close the atmosphere opening hole 50. In addition, the negative pressure generation device 47 generates negative pressure to put the negative pressure chamber 43*b* in a negative pressure state, and the diaphragm 37 is elastically deformed (displaced) toward the negative pressure chamber 43*b* against the urging force of the coil spring 42. That is, the pump 43 starts the suction action again. As a result, the diaphragm 37 is displaced to the top dead point so as to increase the volume of the pump chamber 43*a*, and the pump chamber 43*a* is put in the negative pressure state. The negative pressure causes the suction-side valve body 36 to be elastically deformed (displaced) in the valve opening direction. Therefore, the first flow channel 15*a* and the second flow channel 15*b* communicate with each other through the through hole 36*a* of the suction-side valve body 36, and ink is sucked from the ink cartridge 13 to the pump chamber 43*a* again. Therefore, the pump 43 performs the same ejection action as described above, and thus ink is pressurized and supplied from the pump chamber 43*a* to the recording head 12 through the downstream-side ink flow channel.

In the printer 11, air bubbles may enter the recording head 12 through the nozzle 16, or an ink solvent may evaporate from the nozzle 16 and an increase in ink viscosity, ink hardening, or dust sticking may occur. The increase in ink viscosity, ink hardening, or dust sticking may cause clogging in the nozzle. In this case, in a state where a chock valve provided in the ink flow channel is closed, and the recording head 12 is sucked. Then, when negative pressure increases to a certain point, the choke valve is opened, and thickened ink mixed with air bubbles is sucked and removed from the recording head at a stroke. This is called choke cleaning. In the printer 11 of this embodiment, such choke cleaning is performed as follows.

First, in the state of FIG. 1, the cap 19 is brought into contact with the nozzle forming surface 12*a* of the recording head 12 so as to surround the nozzle 16, and in this state, the suction pump 20 is driven. When this happens, the cap 19 in contact with the nozzle forming surface 12*a* of the recording head 12 is put in the negative pressure state, and the recording head 12 is sucked by a suction force based on the negative pressure. At this time, if the ejection-side valve body 38 of the ejection-side valve 45 serving as a choke valve is temporarily opened, the negative pressure is applied through the ink flow channel 15 so as to close the ejection-side valve body 38, and thus the ejection-side valve 45 is maintained to be closed.

Next, the driving motor is forward driven 49, and as the negative pressure generation device 47 is driven, the pump 43 performs the suction action. Therefore, the suction-side valve body 36 of the suction-side valve 41 is opened, and the ink is sucked into the pump chamber 43*a* from the ink cartridge 13. Then, if the volume of the pump chamber 43*a* increases as the diaphragm 37 is displaced to the top dead point, and ink is sucked, the driving motor 49 is reversely driven. When this happens, the atmosphere opening mechanism 48 opens the atmosphere opening valve 53 to release the negative pressure state of the negative pressure chamber 43*b*. For this reason, the diaphragm 37 is urged in a direction to decrease the volume of the pump chamber 43*a*, and ink is ejected from the pump chamber 43*a*, for example, at an ink ejection pressure of approximately 30 kpa.

As a result, the suction-side valve body 36 of the suction-side valve 41 is closed, and the ejection-side valve body 38 of the ejection-side valve 45 is opened. Then, pressurized ink ejected from the pump chamber 43*a* is pressurized and supplied to a downstream side from the ejection-side valve 45. At this time, the suction force of the suction pump 20 cancel the increased negative pressure, and thus ink on an upstream side from the ejection-side valve 45 in the ink flow channel 15 is quickly sucked toward the recording head 12. Therefore, thickened ink mixed with air bubbles in the recording head 12 is discharged from the nozzle 16 into the cap 19 at a stroke, and is then discharged to the waste liquid tank 21.

In this case, in the suction-side valve 41 on an upstream side from the pump chamber 43*a*, the suction-side valve body 36 is opened. For this reason, even if the ejection-side valve body 38 of the ejection-side valve 45 is opened, and ink is quickly sucked toward the recording head 12, there is no case in which ink is sucked toward the recording head 12 from the upstream side of the suction-side valve 41. Therefore, in the printer 11 of this embodiment, choke cleaning can be performed while the amount of ink consumption in the ink cartridge 13 can be suppressed.

According to this embodiment, the following effects can be obtained.

(1) In the foregoing embodiment, when the ejection-side valve 45 on the downstream side is open, the suction-side valve 41 on the upstream side is closed to close the ink flow channel 15. For this reason, in a state where the ejection-side valve 45 provided in the ink flow channel 15 is closed, the negative pressure caused by the suction force of the suction pump 20 is applied to the ink flow channel 15 through the recording head 12. In this state, even if the ejection-side valve 45 is open, the ink supply to the downstream side is suppressed by the closed suction-side valve 41 on the upstream side. Therefore, wasteful consumption of ink in the ink cartridge 13 can be suppressed.

(2) In the foregoing embodiment, the pump 43 has the pump chamber 43*a* between the suction-side valve 41 and the ejection-side valve 45 in the ink flow channel 15, and performs a pump action. The pump action of the pump 43 enables the suction-side valve 41 on the upstream side from the pump chamber 43*a* and the ejection-side valve 45 on the downstream side to be alternately opened and closed. For this reason, although a large pressurization unit for pressurizing the ink cartridge 13 is not provided, ink can be supplied from the upstream side toward the downstream side, that is, from the ink cartridge 13 toward the recording head 12 through the ink flow channel 15 little at a time.

(3) In the foregoing embodiment, when the pump 43 performs the suction action, the diaphragm 37 of the pump 43 is displaced toward the negative pressure chamber 43*b* against the urging force of the coil spring 42 as the negative pressure generation device 47 is driven, and thus the volume of the negative pressure chamber 43*b* decreases. Accordingly, the volume of the pump chamber 43*a* increases by the decreased amount, and the pump chamber 43*a* is pressurized (negative pressure). Next, when the pump 43 performs the ejection action, the negative pressure state of the negative pressure chamber 43*b* is released by atmosphere opening. Then, the diaphragm 37 of the pump 43 is displaced toward the pump chamber 43*a* by the urging force of the coil spring 42, and the volume of the negative pressure chamber 43*b* increases. Accordingly, the volume of the pump chamber 43*a* decreases by the increased amount, and the pump chamber 43*a* is pressurized. For this reason, when the pump 43 performs the pump action to supply ink, the diaphragm 37 is preferably configured to be deformed against the urging force of the coil spring 42 only if the pump 43 performs the suction action. Otherwise, the diaphragm 37 is displaced to the original state by the urging force of the coil spring 42, and as a result, a drive load of the pump 43 can be reduced.

(4) In the foregoing embodiment, the ejection-side valve body 38 of the ejection-side valve 45 is constantly in the valve close state by the urging force of the coil spring 44, but when the pump 43 performs the ejection action and the pressure of ink ejected from the pump chamber 43*a* is applied to the ejection-side valve body 38 as positive pressure, the ejection-side valve body 38 is switched to the valve open state. That is, with the above-described configuration, the open/close state of the ejection-side valve 45 can be automatically switched, without providing a special control mechanism.

(5) In the foregoing embodiment, the suction-side valve body 36 of the suction-side valve 41 is constantly in the valve close state by the urging force of the coil spring 40, but when the pump 43 performs the suction action and the pressure of ink sucked into the pump chamber 43*a* is applied to the suction-side valve body 36 as negative pressure, the suction-side valve body 36 is switched to the valve open state. That is, with the above-described configuration, the open/close state of the suction-side valve 41 can be automatically switched, without providing a special control mechanism.

The foregoing embodiment may be modified as follows.

In the foregoing embodiment, before choke cleaning is performed, the driving motor 49 may be forward driven, and the pump 43 may perform the suction action. In this case, the pressure in the pump chamber 43*a* decreases, and the ejection-side valve 45 is closed when choke cleaning starts.

That is, when choke cleaning is performed in a state where the ejection-side valve body 38 of the ejection-side valve 45 serving as a choke valve is open, the pump chamber 43*a* and the concave portion 32 communicate with each other. Accordingly, after ink is sucked and discharged to the downstream side until both chambers (the pump chamber 43*a* and the concave portion 32) have a pressure (less than 13 kpa) enough to close the ejection-side valve 45, the ejection-side valve 45 is closed. For this reason, until the ejection-side valve 45 is closed, ink may wastefully flow out to the recording head 12.

Like this modification, if the pump 43 performs the suction action before choke cleaning is performed, the ejection-side valve body 38 of the ejection-side valve 45 is closed, and subsequently, choke cleaning starts, ink can be prevented from wastefully flowing out into the ink flow channel 15 on the downstream side from the pump chamber 43*a* at the beginning of choke cleaning. Then, after the ejection-side valve body 38 of the ejection-side valve 45 is closed, if the pump 43 performs the ejection action, the ejection-side valve body 38 is opened by the ejection pressure from the pump chamber 43*a*, and ink flows into the ink flow channel 15 on the downstream side. Therefore, choke cleaning can be performed with a small amount of ink consumption.

In the foregoing embodiment, as a driving source of the pump 43, a pressure generation device may be used, instead of the negative pressure generation device 47. As the coil spring 42 serving as an urging member, a tension spring may be used, instead of a compression spring. The coil spring 42 formed of a compression spring may be provided in the pump chamber 43*a*, not in the negative pressure chamber 43*b*. In this modification, when the pump 43 performs the suction action, the diaphragm 37 is displaced by the urging force of the spring in a direction to increase the volume of the pump chamber 43*a*. Meanwhile, when the pump 43 performs the ejection action, pressurized air is introduced from the pressure generation device into the upper concave portion 34 of the pump 43 (in this embodiment, the negative pressure chamber 43*b*).

Instead of the negative pressure generation device 47 or the pressure generation device, a cam mechanism may be used as a mechanism for displacing the diaphragm 37. That is, a base end of a traction member having a locking portion is fixed to the diaphragm 37, which is pressed by the coil spring 42 formed of a compression spring, and a cam member is brought into contact with the locking portion of the traction member. Therefore, the diaphragm 37 is displaced by the traction member. In addition, when a tension spring is used, a base end of a pressing member may be fixed to the diaphragm 37, and a front end of the pressing member may be pressed against the diaphragm 37 by a cam member.

The pump 43 may be a piston pump in which a piston reciprocates in the negative pressure chamber 43*b* and directly presses the pump chamber 43*a*, and the volume of the pump chamber 43*a* is changed in accordance with the reciprocation. Similarly, the ejection-side valve 45 may have a piston structure.

In the foregoing embodiment, as a driving source of the pump 43, a device having functions of the pressure generation device and the negative pressure generation device 47 may be used. In this case, pressure and negative pressure are alternately generated. Therefore, the diaphragm 37 can be displaced to perform the pump action, without providing an urging member, and thus ink can be supplied.

In the foregoing embodiment, as the ejection-side valve 45 or the suction-side valve 41, a solenoid valve may be used. In this case, it is necessary to switch the open/close state of the respective valves 41 and 45 in accordance with the state of the pump 43.

In the foregoing embodiment, as a unit that supplies pressurized ink from the upstream side toward the downstream side, instead of the pump 43 in the ink flow channel 15, a pressurization unit that pressurizes ink in the ink cartridge 13 may be provided.

In the foregoing embodiment, instead of the coil springs 40, 42, and 44, other urging members, such as a plate spring, rubber, and the like, may be used. With the urging members, the urging force to be applied to ink in the suction-side valve 41, the ejection-side valve 45, and the pump chamber 43*a* can be maintained, regardless of the state of the negative pressure generation device 47.

Although in the foregoing embodiment, air is used as the working fluid of the pump 43, a liquid, such as silicon oil, may be used as the working fluid.

The term "liquid" used herein includes a liquid other than ink (an inorganic solvent, an organic solvent, a solution, a liquid resin, or a liquid metal (metal melt)), a liquid state material, in which particles of function material are dispersed or mixed, a fluid state material, such as gel. A liquid ejecting apparatus that ejects or discharges the "liquid" may be a liquid state material ejecting apparatus that ejects a liquid state material, in which an electrode material or a color material (pixel material) is dispersed or dissolved and is used in manufacturing a liquid crystal display, an EL (Electro Luminescence) display, or a field emission display, a liquid ejecting apparatus that ejects a bioorganic material to be used in manufacturing a biochip, or a liquid ejecting apparatus that ejects a liquid (sample) as a precision pipette. In addition, it may be a liquid ejecting apparatus that pinpoint ejects lubricant to a precision instrument, such as a watch or a camera, a liquid ejecting apparatus that ejects on a substrate a transparent resin liquid, such as ultraviolet cure resin, to form a fine hemispheric lens (optical lens) for an optical communication element, a liquid ejecting apparatus that ejects an etchant, such as acid or alkali, to etch a substrate, or a liquid ejecting apparatus that ejects a liquid state material, such as gel (for example, physical gel).

Although in the foregoing embodiment, the liquid ejecting apparatus is embodied in the ink jet printer 11, it may be embodied in a liquid ejecting apparatus that ejects or discharges a liquid other than ink. The invention may be used in various liquid ejecting apparatuses that have liquid ejecting head for ejecting a small amount of liquid droplets. The liquid droplet means the state of a liquid to be ejected from the liquid ejecting apparatus, and includes a granular shape, a teardrop shape, and a tailed threadlike shape. Any liquid may be used insofar as it can be ejected from the liquid ejecting apparatus. For example, a material of a liquid phase is preferably used. In addition, a fluid state material, such as a liquid state material having high or low viscosity, sol, gel water, an inorganic solvent, an organic solvent, a solution, a liquid resin, or a liquid metal (metal melt), may be used. In addition to a liquid as one state of a material, a material, which is obtained by dissolving, dispersing, or mixing particles of function material containing solid material, such as pigment or metal particles, in a solvent, may be used. As the liquid, ink described in the foregoing embodiment or liquid crystal may be exemplified. Ink includes various liquid compositions, such as aqueous ink, oil-based ink, gel ink, and hot-melt ink. Specific examples of the liquid ejecting apparatus include a liquid ejecting apparatus that ejects a liquid, in which a material, such as an electrode material or a color material, is dispersed or dissolved, and is used in manufacturing a liquid crystal display, an EL (Electro Luminescence) display, a field emission display, and color filters, a liquid ejecting apparatus that ejects a bioorganic material to be used in manufacturing a bio-chip, a liquid ejecting apparatus that ejects a liquid (sample) as a precision pipette, a textile printing apparatus, and a micro dispenser. In addition, a liquid ejecting apparatus that pinpoint ejects lubricant to a precision instrument, such as a watch or a camera, a liquid ejecting apparatus that ejects on a substrate a transparent resin liquid, such as ultraviolet cure resin, to form a fine hemispheric lens (optical lens) for an optical communication element, and a liquid ejecting apparatus that ejects an etchant, such as acid or alkali, to etch a substrate may be used. The invention may be applied to one of the liquid ejecting apparatuses.

What is claimed is:

1. A liquid supply device comprising:

a liquid supply channel that supplies a liquid from an upstream side as a liquid supply source side to a downstream side, on which the liquid is consumed;

a first valve that is provided in the liquid supply channel to open and close the liquid supply channel;

a second valve that is provided on a downstream side from the first valve in the liquid supply channel to open and close the liquid supply channel, wherein the first valve is closed when the second valve is open, and a pump that pumps a pump chamber provided in the liquid supply channel between the first valve and the second valve, wherein, when the pump performs a suction action to increase the volume of the pump chamber and suck the liquid into the pump chamber, the first valve is opened and the second valve is closed, and when the pump decreases the volume of the pump chamber to eject the liquid from the pump chamber, the first valve is closed and the second valve is opened.

2. The liquid supply device according to claim 1, wherein the pump includes a displacement member that is displaced so as to increase and decrease the volume of the pump chamber, and an urging member that urges the displacement member in a direction to decrease or increase the volume of the pump chamber.

3. The liquid supply device according to claim 1, wherein the second valve includes a valve body that is displaced between a valve close position where the liquid supply channel is closed and a valve open position where the liquid supply channel is open, and an urging member that urges the valve body toward the valve close position, and when the pressure of the liquid ejected from the pump chamber in accordance with an ejection action of the pump is applied as positive pressure, the valve body is displaced to the valve open position against an urging force of the urging member.

4. The liquid supply device according to claim 1, wherein the first valve includes a valve body that is displaced between a valve close position where the liquid supply channel is closed and a valve open position where the liquid supply channel is open, and an urging member that urges the valve body toward the valve close position, and when the pressure of the liquid sucked into the pump chamber in accordance with a suction action of the pump is applied as positive pressure, the valve body is displaced to the valve open position against an urging force of the urging member.

5. A liquid ejecting apparatus comprising:

a liquid ejecting head that ejects a liquid; and the liquid supply device according to claim 1, which supplies the liquid to the liquid ejecting head.

6. A liquid supply method comprising:

in a state where, when a first valve and a second valve are provided in a liquid supply channel, through which a liquid is supplied from an upstream side as a liquid supply source side toward a downstream side, to open and close the liquid supply channel, and the second valve on a downstream side from the first valve is closed, applying pressure to the liquid supply channel so as to cause the liquid to quickly flow from the upstream side toward the downstream side, and when the second valve is opened to supply the liquid on an upstream side from the second valve to a downstream side, closing the first valve, wherein, after a pump provided between the first valve and the second valve pumps a part of the liquid supply channel as a pump chamber and the second valve is closed, pressure is applied to the liquid supply channel so as to cause ink to quickly flow from the upstream side toward the downstream side.

* * * * *